United States Patent [19]

Schaden

[11] 4,129,991

[45] Dec. 19, 1978

[54] METHOD OF PRODUCING A CONCRETE LINED TUNNEL OR OTHER UNDERGROUND EXCAVATION

[76] Inventor: Karl Schaden, Hameaustrasse 59, Wien 19, Austria

[21] Appl. No.: 846,522

[22] Filed: Oct. 28, 1977

[51] Int. Cl.[2] ..... E21D 11/15

[52] U.S. Cl. ..... 405/150

[58] Field of Search ..... 61/45 R, 45 B, 45 C, 61/43, 42

[56] References Cited

U.S. PATENT DOCUMENTS 1,853,224 4/1932 Proctor ..... 61/45 R

FOREIGN PATENT DOCUMENTS 1966497 4/1973 Fed. Rep. of Germany ..... 61/45 B
2305904 2/1974 Fed. Rep. of Germany ..... 61/45R
2457427 10/1976 Fed. Rep. of Germany ..... 61/45 R

*Primary Examiner*—Jacob Shapiro
*Attorney, Agent, or Firm*—Michael J. Striker

[57] ABSTRACT

A method of producing a concrete lined tunnel, or other concrete lined underground excavation, in which first a rough tunnel is excavated of a cross-section which is greater than that of the tunnel to be lined with concrete, whereafter a lost form is connected by support members to the inner surface of the rough tunnel spaced at a distance therefrom which corresponds to the expected maximum settlement of the inner surface under the influence of the rock pressure acting thereon, and finally applying a concrete lining to the inner surface of the lost form, while the rigidity of the support members relative to the rock pressure is made smaller than that of the concrete lining so that the support members may yield during the settlement of the rough tunnel.

7 Claims, 5 Drawing Figures

METHOD OF PRODUCING A CONCRETE LINED TUNNEL OR OTHER UNDERGROUND EXCAVATION

BACKGROUND OF THE INVENTION

The present invention relates to a method of producing a concrete lined tunnel or other concrete lined excavation.

In such methods as known in the art, a rough tunnel is first excavated and the space between the inner surface of the rough tunnel and the desired inner surface of the finished tunnel is filled with concrete. Due to the irregular inner surface of the rough tunnel, on the one hand, and the expected settlement of the inner surface due to the rock pressure acting thereon, on the other hand, the concrete lining has to be formed relatively heavy which requires a large amount of concrete. In order to at least partially obviate this disadvantage, it has already been suggested to wait with the application of the concrete lining until the rough tunnel has settled. The dimension of the settlement of the rough tunnel may in the uppermost portion of the latter be up to 70 centimeters and the time of such settlement may be 3 to 4 years. This last-mentioned method has, therefore, the disadvantage that a considerable time span is necessary between the excavation of the rough tunnel and finishing the tunnel by applying a concrete layer to the inner surface thereof.

SUMMARY OF THE INVENTION

It is an object of the present invention to provide a method of producing a concrete lined tunnel which avoids the above-described disadvantages of such methods known in the art.

With these and other objects in view, which will become apparent as the description proceeds, the method according to the present invention of producing a concrete lined tunnel, or other concrete lined underground excavation, mainly comprises the steps of first excavating a rough tunnel or a cross-section defined by the inner surface thereof which is greater than that of the tunnel to be lined with concrete, connecting a lost form by support members to the inner surface of the rough tunnel at a distance spaced from the inner surface corresponding to the expected maximum settlement of the inner surface under the influence of the rock pressure acting thereon, applying a concrete lining to a surface of the lost form facing away from the inner surface and making the rigidity of the support members relative to the rock pressure smaller than the rigidity of the concrete lining so that the support members may yield during the settlement of the rough tunnel.

In a tunnel produced according to the method of the present invention, the concrete lining may be formed immediately after excavation of the rough tunnel and in which, nevertheless, the rock pressure occurring during the settlement of the rough tunnel has not to be taken up by the concrete lining. During a subsequent settlement of the inner surface of the rough tunnel, the rock pressure is initially not transmitted to the concrete lining since the support members carrying the lost form will yield under the influence of the rock pressure.

The connection, respectively the construction of the support members may be carried out in different ways. The simplest way in many cases will be to form in the rough tunnel a plurality of bores extending outwardly from the inner surface theof and to attach the inner end portions of the support members by frictional contact, respectively by keys in the bores, while leaving between the closed outer ends of the bores and the facing outer ends of the support members a free space. The frictional contact will be sufficient to properly withstand the small load acting on the support members and caused by lost form and the concrete lining provided thereon, whereas upon occurring of the rock pressure the frictional contact will be released so that the support members may move into the free space of the bores.

It is, however, also possible to provide the support members with a predetermined breaking point, respectively to use telescoping support members. In such arrangements the support members will break at the predetermined breaking point, respectively support members will telescopically collapse upon occurring of the rock pressure and corresponding settlement of the inner surface of the rough tunnel.

The step of connecting a lost form to the inner surface preferably comprises the step of fastening a framework to the support members and fastening a water-deflecting foil to the framework.

The novel features which are considered as characteristic for the invention are set forth in particular in the appended claims. The invention itself, however, both as to its construction and its method of operation, together with additional objects and advantages thereof, will be best understood from the following desription of specific embodiments when read in connection with the accompanying drawings.

DESCRIPTION OF THE PREFERRED EMBODIMENTS

Figure 1:
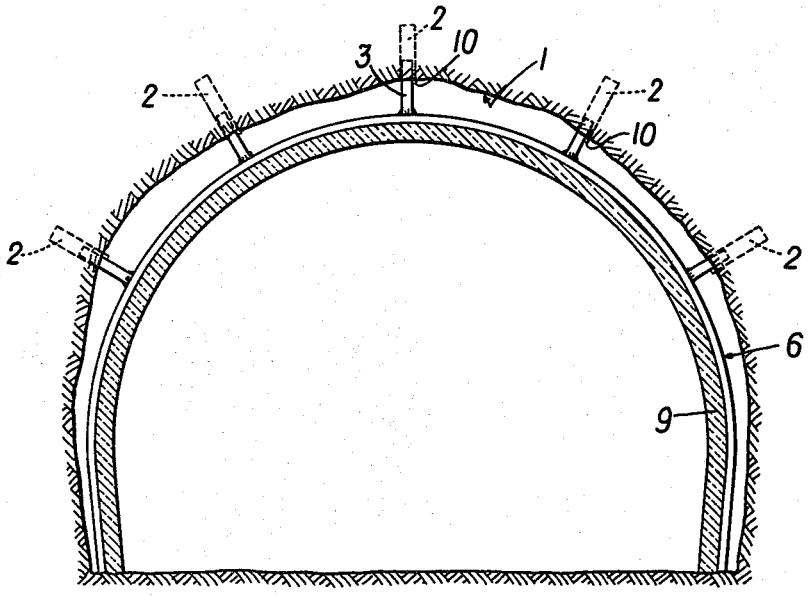
FIG. 1 illustrates in cross-section the method accoding to the present invention.
Figure 2:
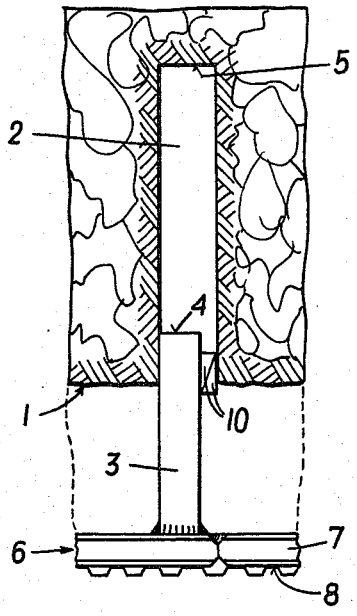
FIGS. 2–5 illustrate various modifications of support members used in carrying out the present invention.

Referring now to the drawing and more specifically to FIGS. 1 and 2, it will be seen that the method according to the present invention may be carried out by first forming a rough tunnel having an inner surface 1 and having a cross-section, defined by this inner surface, which is greater than the cross-section to which the concrete lining has to be applied. A plurality of bores 2 are then formed, which extend spaced from each other outwardly into the rock surrounding the inner surface 1 of the rough tunnel, into which outer portions of support members 3 are respectively inserted. The length of the bores 2 is so great that between the outer end 4 of each support member 3 and the outer closed end of each bore a free space remains, which is at least equal and preferably greater than the expected settlement of the rock at each bore. As already mentioned such settlement may at the upper end of the rough tunnel reach a dimension up to 70 centimeters.

A framework, for instance formed from bent I-beams 7 and non-illustrated connecting beams, serves for fastening a water deflecting foil 8. The foil 8 is preferably formed from plastic material provided with a plurality of small projections on the surface of the foil 8 facing away from the I-beams 7. The framework forms together with the foil 8 connected thereto a lost form 6 for the concrete lining 9 to be applied to the surface of the foil provided with the projections.

The lost form 6 is supported spaced from the inner surface 1 by means of the support members 3 whereby the support members 3 are held in the bores 2 by means of keys 10 or by direct frictional contact.

In accordance with the method of the present invention a rough tunnel with an inner surface 1 is first excavated and then a plurality of bores 2 extending spaced from each other outwardly from the inner surface are formed. The lost form 6 is then supported, spaced from the inner surface 1 in accordance with the expected settlement thereof under the influence of the rock pressure, by means of the support members 3. The outer portions of the support members 3 are fastened in the bores 2 for instance by the keys 10 or by direct frictional contact between the outer surfaces of the outer portions of the support members 3 and the inner surfaces of the bores 2. Subsequently thereto the lost form 6 is connected in any convenient manner to the inner ends of the support members 3 and finally the concrete lining 9 is applied to the surface of the lost form which faces away from the inner surface 1.

During the settlement of the surrounding rock, the frictional contact of the keys 10 will not be sufficient in order to transmit the rock pressure onto the lost form 6 and the concrete lining 9 applied thereto. In fact the key connection will be released so that the support members 3 may further penetrate into the bores.

Figure 3:
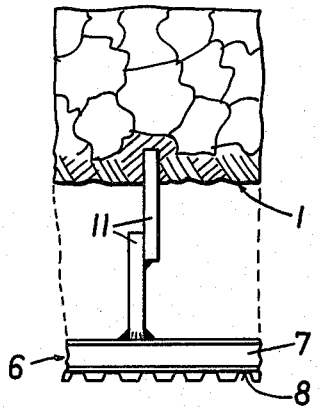

In the embodiment shown in FIG. 3, each of the support members is constituted by a pair of elongated members 11 which have overlapping portions which are connected by spot welding to each other. The strength of the spot welding is chosen in such a manner to be sufficient to hold the lost form 6 and the concrete lining 9 applied thereto, but not sufficient to transmit the rock pressure during the settlement to the lost form 6 and the concrete line 9 applied thereto. Instead of connecting the overlapping portions of the members 11 by spot welding, these overlapping portions may also be connected by shear pins having a shear strength corresponding to that of the spot welding.

Figure 4:
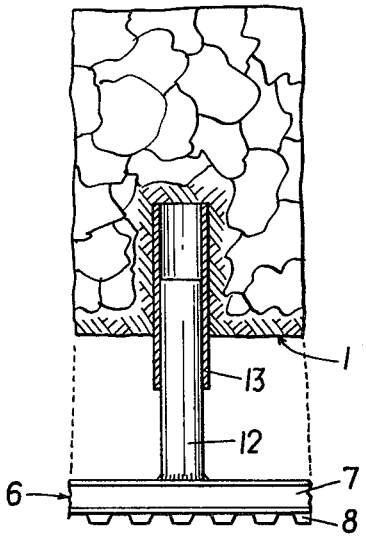

FIG. 4 illustrates a further embodiment in which pistons 12 are welded to the beams 7 of the lost form 6. The pistons 12, of which only one is shown in FIG. 4, respectively project with end portions thereof into cylinders 13, anchored in bores formed in the rough tunnel. The inner diameters of the cylinders 13 are dimensioned to hold the pistons 12 by frictional contact. During settlement of the rock, this frictional contact is insufficient to transmit the rock pressure to the lost form and the pistons 12 are moved further into the cylinders 13.

Figure 5:
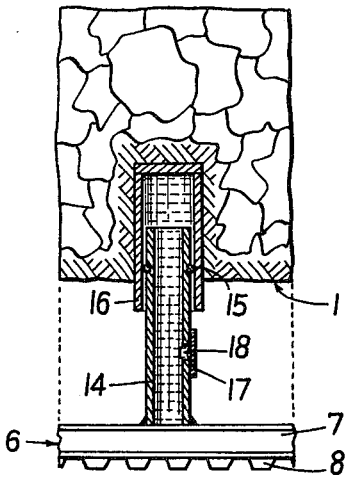

In the embodiment shown in FIG. 5, tubular pistons 14 are welded to the beams 7 of the lost form 6. The tubular pistons are guided by means of sealing rings 15 in a fluid tight manner in cylinders 16 anchored in the rock of the rough tunnel. Each of the tubular pistons 14 is formed in a portion thereof located outside the respective cylinder 16 with a transverse bore 18, closed by a bursting disc 17 which yields under a predetermined overpressure in the interior of the telescoping members 14, 16.

During construction of the tunnel the pistons 14 are introduced into the respective cylinder and fluid under small pressure is introduced through not illustrated conduits into the telescoping members 14, 16. The pressure of the fluid is thereby determined in such a manner that the lost form 6 and the not yet hardened concrete lining 9 applied thereto is securely carried. After hardening of the concrete lining and settling of the rock, the fluid pressure in the interior of the members 14, 16 increases, and when this pressure surpasses a predetermined maximum pressure the disc 17 will rupture and the tubular piston 14 will further penetrate into the cylinder 16.

It will be understood that each of the elements described above, or two or more together, may also find a useful application in other types of methods for the production of tunnels differing from the types described above.

While the invention has been illustrated and described as embodied in a method for the production of a concrete lined tunnel, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of producing a concrete lined tunnel or other concrete lined underground excavation, comprising the steps of first excavating a rough tunnel of a cross-section defined by an inner surface thereof which is greater than that of a tunnel to be lined with concrete; connecting a lost form by support members to the inner surface of said rough tunnel at a distance spaced from said inner surface corresponding to the expected maximum settlement of said inner surface under the influence of the rock pressure acting thereon; applying a concrete lining to a surface of said lost form facing away from said inner surface; and making the rigidity of said support members relative to the rock pressure smaller than the rigidity of the concrete lining so that said support members may yield during the settlement of said rough tunnel.

2. A method as defined in claim 1, wherein said step of connecting a lost form to said inner surfaces comprises the steps of fastening a framework to said support members and fastening a water deflecting foil to said framework.

3. A method as defined in claim 1, and including the step of forming in said rough tunnel a plurality of bores extending outwardly from said inner surface and each having an outer closed end, placing outer portions of said support members respectively into said bores, with outer ends of said support members respectively spaced from the closed outer ends of said bores by a distance which is at least equal to the expected maximum settlement, and yieldably fastening said support members in said bores.

4. A method as defined in claim 3, wherein said step of yieldably fastening said support members in said bores comprises the step of fastening said support members by key means.

5. A method as defined in claim 1, wherein said step of making the rigidity of said support members relative to said rock pressure smaller than that of said concrete lining comprises the step of providing a predetermined breaking point in each support member.

6. A method as defined in claim 5, wherein said step of providing a predetermined breaking point comprises the step of forming each of said support members of two parts overlapping each other at portions thereof intermediate said inner surface and said framework and connecting said overlapping portions by spot welding.

7. A method as defined in claim 1, wherein said step of making the rigidity of said support members relative to said rock pressure smaller than that of said concrete lining comprises the step of providing telescoping support members movable between an extended and a collapsed position.

* * * * *